US006410816B2

(12) United States Patent
Takasaki et al.

(10) Patent No.: US 6,410,816 B2
(45) **Date of Patent: *Jun. 25, 2002**

(54) PROCESSING OIL AND METHOD FOR PRODUCING THE SAME

(75) Inventors: Masami Takasaki; Meishi Tanaka, both of Sodegaura (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/782,315

(22) Filed: Feb. 14, 2001

Related U.S. Application Data

(62) Division of application No. 09/292,310, filed on Apr. 15, 1999, now abandoned.

(30) Foreign Application Priority Data

Apr. 17, 1998 (JP) ..... 10-107194

(51) Int. Cl.[7] ..... C07C 7/00; C07C 7/10

(52) U.S. Cl. ..... 585/833; 585/804; 585/836; 585/838; 208/314

(58) Field of Search ..... 585/804, 833, 585/836, 838; 208/314

(56) References Cited

U.S. PATENT DOCUMENTS 5,178,750 A * 1/1993 Mead ..... 208/309
6,103,808 A * 8/2000 Hashimoto ..... 524/484
6,248,929 B1 * 6/2001 Kaimai et al. ..... 585/241

FOREIGN PATENT DOCUMENTS

EP 0417980 A1 * 3/1991

* cited by examiner

*Primary Examiner*—Walter D. Griffin
*Assistant Examiner*—Tam M. Nguyen
(74) *Attorney, Agent, or Firm*—Oblon, Spivak, McClelland, Maier & Neustadt, P.C.

(57) ABSTRACT

The processing oil contains polycyclic aromatic hydrocarbon, which is a substance known to be toxic to the human body, in an amount of less than 3 wt. % and an aromatic hydrocarbon in an amount of 25 wt. % or more, and has a kinematic viscosity at 100° C. of 10–30 $mm^2/s$, a density of 0.870–970 $g/cm^3$, and a 5 vol. % recovery temperature of 370–530° C. The processing oil exhibits excellent performance which has conventionally been obtained. The processing oil can be produced by a method in which oil mixture comprising an extract obtained through extraction from mineral oil by use of a polar solvent in an amount of 40–97 vol. % and lubricating base oil in an amount of 3–60 vol. % is subjected to extraction treatment by use of a polar solvent.

4 Claims, No Drawings

PROCESSING OIL AND METHOD FOR PRODUCING THE SAME

This application is a divisional of prior application U.S. Ser. No. 09/292,310, filed Apr. 15, 1999, now abandoned.

BACKGROUND OF THE INVENTION

1. Field of the Invention

The present invention relates to processing oil used for a variety of applications, including rubber processing, and more particularly to processing oil which contains polycyclic aromatic hydrocarbon (hereinafter may be abbreviated as PCA)—a substance known to be toxic to the human body—in an amount of less than 3 wt. % and which exhibits excellent performance characteristics that are conventionally required. The present invention also relates to a method for producing the processing oil.

2. Background Art

Processing oil has a variety of uses, functioning as a lubricant or a solvent depending on use. Primarily, it is used for processing rubbers such as natural rubber and synthetic rubber. It also serves as an extender in rubber processing. Moreover, processing oil is used as a plasticizer for thermoplastic resins, a printing ink component, and a softening agent for reclaimed asphalt. In accordance with individual uses, processing oil has been required to possess appropriate physical and performance characteristics, such as viscosity, density, volatility, or compatibility with rubber. For example, processing oil used for processing rubber desirably has good compatibility with rubber to enhance processability, appropriate viscosity in accordance with use, and resistance to deterioration, and therefore, processing oils meeting these requirements have been preferred.

However, a problem arising from toxicity of PCA has recently demanded reduction of PCA content of processing oil; particularly, in processing oil used in automotive tires, because dust thereof causes environmental pollution.

Thus, processing oils of reduced PCA content are under development. For example, Japanese Kohyo Patent Publication No. 06-505524 discloses a rubber composition using processing oil having a low PCA content. However, the processing oil has a high viscosity, which imposes limitations on the application thereof.

European Patent No. 0489371 B1 discloses a method for producing low-PCA processing oil formed of a naphthene-aromatic hydrocarbon mixture through supercritical extraction by use of a medium such as carbon dioxide.

European Patent No. 417980 A1 discloses a method for producing low-PCA and high-aromatic hydrocarbon processing oil through two-step-extraction performed by use of a polar solvent. In this method, however, a primary extract, which serves as a starting material for a second extraction step, has a density nearly equal to that of the polar solvent and strong affinity to the polar solvent. Thus, predetermining extraction conditions is considerably difficult and extraction efficiency is disadvantageously low; for example, the maximum yield reported in working examples is 51%.

SUMMARY OF THE INVENTION

The present inventors have conducted earnest studies, and have found that processing oil of low PCA content which has excellent performance can be obtained by mixing a primary extract and lubricating base oil and subjecting the mixture to extraction with a solvent. The present invention has been accomplished based on this finding.

Accordingly, an object of the present invention is to provide a processing oil having a reduced content of PCA—which is toxic to the human body—and excellent performance characteristics, such as yielding rubber of high processability and bleeding resistance, which have conventionally been demanded of processing oils. Another object of the present invention is to provide a method for producing the processing oil.

In a first aspect of the present invention, there is provided a processing oil containing a polycyclic aromatic hydrocarbon in an amount of less than 3 wt. % and an aromatic hydrocarbon in an amount of 25 wt. % or more; having a kinematic viscosity at 100° C. of 10–30 $mm^2/s$, a density of 0.870–970 $g/cm^3$, and a temperature for 5 vol. % recovery by distillation (hereinafter called "5 vol. % recovery temperature") of 370–530° C.

In a second aspect of the present invention, there is provided a method for producing a processing oil having a content of polycyclic aromatic hydrocarbon of less than 3 wt. %, in which an oil mixture comprising an extract obtained through extraction from mineral oil by use of a polar solvent in an amount of 40–97 vol. % and lubricating base oil in an amount of 3–60 vol. % is subjected to extraction treatment making use of a polar solvent.

Preferably, the extraction treatment is performed through countercurrent extraction making use of furfural as an extraction solvent under the following conditions: a solvent ratio of 0.5–2.5, a top temperature of an extraction tower of 50–110° C., and a bottom temperature of the same of 30–80° C.

Preferably, the method is adapted to produce the processing oil of the first aspect of the present invention.

The processing oil according to the present invention contains polycyclic aromatic hydrocarbon in an amount of 3 wt. % or less; has excellent physical and performance properties; and is advantageously used in applications such as rubber processing oil, a plasticizer for thermoplastic resins, a printing ink component, or a softening agent for reclaimed asphalt. The present invention provides a method for producing the above processing oil at low cost and high productivity.

DESCRIPTION OF PREFERRED EMBODIMENTS

The processing oil according to the first aspect of the present invention will first be described.

The processing oil according to the present invention may assume any of a variety of compositions and characteristics in accordance with the intended use and the production method; however, the processing oil satisfies the following five essential requirements.

(1) Polycyclic Aromatic Hydrocarbon (PCA)

The processing oil according to the present invention must have a PCA content of less than 3 wt. %. In Europe, handling of mineral oil having a PCA content of 3% or more is under regulation due to carcinogenicity, and handling of processing oil is also limited accordingly. The PCA content shown herein is measured through a method of The British Petroleum Institute (IP346/92).

(2) Aromatic Hydrocarbon

The aromatic hydrocarbon content of the processing oil is 25 wt. % or more, preferably 35 wt. % or more, more preferably 45 wt. % or more. Aromatic hydrocarbon, which determines affinity and compatibility of processing oil to rubber and other materials, is preferably contained in a large amount. When processing oil is added to rubber, aromatic hydrocarbon contained in the processing oil enhances processability and extendability of rubber, and bleeding of a plasticizer from aromatic vulcanized rubber is effectively prevented. When processing oil is used as a component of printing ink, aromatic hydrocarbon contained in the processing oil is effective for enhancement of compatibility to a resin component. The aromatic hydrocarbon content is measured in accordance with ASTM-D2007.

(3) Viscosity

The kinematic viscosity of the processing oil at 100° C. is 10–30 $mm^2/s$, preferably 12–30 $mm^2/s$, more preferably 13–25 $mm^2/s$. When the viscosity is less than 10 $mm^2/s$, physical properties at an ordinary state of vulcanized rubber produced by use of processing oil deteriorate, whereas when it is in excess of 30 $mm^2/s$, processability and operability during blending processing oil with rubber or other materials decrease. The kinematic viscosity of the processing oil is measured in accordance with ASTM-D445.

(4) Density

The density of the processing oil is 0.870–0.970 $g/cm^3$, preferably 0.900–0.960 $g/cm^3$. The density must fall within an appropriate range, since the density differs considerably from a conventionally adapted range during blending of processing oil with rubber or ink, to thereby require modification of blending operation. The density of the processing oil is measured in accordance with ASTM-D4052.

(5) 5 Vol. % Recovery Temperature

Among the distillation properties of the processing oil, the 5 vol. % recovery temperature is 370–530° C. When the temperature is lower than 370° C., the processing oil becomes easily volatile to cause deterioration of physical properties of rubber after thermal aging, due to evaporation thereof. The 5 vol. % recovery temperature is considered to be an approximate index of viscosity, and when it is higher than 530° C., the viscosity of the processing oil increases to thereby cause deterioration of operability during blending with rubber. The 5 vol. % recovery temperature is measured in accordance with ASTM-D2887.

When processing oil satisfies the above requirements, it can suitably be used as the processing oil according to the present invention. For example, it can suitably be used for producing natural and synthetic rubber having a low PCA content and as a plasticizer for thermoplastic resins. Furthermore, it may also be used as a printing ink component and a softening agent for reclaimed asphalt.

The method for producing processing oil according to the second aspect of the present invention will next be described.

As the extract serving as a starting material of the present invention, there may be employed general extracted oil from mineral oil that is obtained during a step for refining lubricating oil. Briefly, the extract may be produced through steps of distillation under normal pressure, distillation under reduced pressure, and solvent extraction of a variety of crude oils. During the step of solvent extraction, customary polar solvents such as furfural, phenol, and N-methylpyrrolidone may be used. Preferably, the extract contains no asphaltene. Furthermore, the extract preferably has a PCA content of 40 wt. % or less; an aromatic hydrocarbon content of 40 wt. % or more; a kinematic viscosity at 100° C. of 10–60 $mm^2/s$; a density of 0.900–1.200 $g/cm^3$; and a 5 vol. % recovery temperature of 370–530° C.

As the lubricating base oil serving as the other starting material of the present invention, there may be employed general lubricating base oil produced from mineral oil that is obtained during a step for refining lubricating oil. Specifically, the lubricating base oil may be produced by refining, which includes solvent refining, hydrorefining, or hydrocracking, or optional dewaxing, fractions obtained through steps of distillation under normal pressure, distillation under reduced pressure, and deasphalting of a variety of crude oils. Furthermore, the lubricating base oil preferably has a PCA content of 10 wt. % or less; an aromatic hydrocarbon content of 5 wt. % or more; a kinematic viscosity at 100° C. of 5–70 $mm^2/s$; a density of 0.860–1.000 $g/cm^3$; and a 5 vol. % recovery temperature of 370–530° C.

The extract and the lubricating base oil are mixed to thereby form an oil mixture serving as a starting material to be subjected to extraction treatment. The required mixing proportion of the extract based on the oil mixture is 40–97 vol. %, preferably 50–95 vol. %, and that of the lubricating oil is 3–60 vol. %, preferably 5–50 vol. %. The oil mixture comprising the above-described two fractions preferably has a PCA content of 40 wt. % or less; an aromatic hydrocarbon content of 25 wt. % or more; a kinematic viscosity at 100° C. of 5–100 $mm^2/s$; a density of 0.860–1.200 $g/cm^3$; and a 5 vol. % recovery temperature of 370–530° C. Preferably, the oil mixture also contains substantially no asphaltene.

The above-described oil mixture is subjected to extraction treatment by use of a polar solvent, to thereby obtain processing oil to be desired. The extraction treatment is preferably performed through continuous extraction, particularly preferably countercurrent extraction. No particular limitation is imposed on the polar solvent for extraction, and solvents such as furfural, phenol, or N-methylpyrrolidone may be used as the extraction solvent, with furfural being particularly preferred.

Although the conditions of extraction treatment are appropriately selected in accordance with factors such as the type of extraction, the solvent for extraction, and the oil mixture serving as a starting material for extraction, the extraction is suitably performed though countercurrent extraction by use of furfural as a solvent for extraction. In this case, the solvent ratio; i.e., the ratio of solvent to oil mixture, is 0.5–2.5, preferably 1.0–2.0; the temperature as measured at the top of an extraction tower (hereinafter called the "top temperature") is 50–110° C., preferably 60–100° C.; and the temperature as measured at the bottom of the same (hereinafter called the "bottom temperature") is 30-80° C., preferably 50-70° C. In addition, preferably, the top temperature is not less than the bottom temperature.

Through the above-described treatment, PCA is separated for removal from the bottom of the extraction tower with other impurities. The solvent is removed from the fraction obtained from the top of the extraction tower, to thereby collect the resultant product. Subsequently, properties such as viscosity and 5 vol. % recovery temperature of the product are optionally adjusted through further treatment such as distillation, dewaxing, or secondary refining, to thereby obtain a desired low-PCA-content processing oil.

The processing oil according to the first aspect of the present invention is produced by appropriate selection of the above-mentioned conditions of production.

EXAMPLES

The present invention will next be described in detail by way of examples, which should not be construed as limiting the invention thereto.

Preparation of Oil Mixtures

Extract (X) which is obtained through extraction treatment of a vacuum distillation fraction of a crude oil produced in the Middle East was mixed with lubricating base oils (A) and (B) obtained through hydrorefining and lubricating base oil (C) obtained through solvent refining, to thereby obtain oil mixtures (D) through (I). The properties of extract (X) and lubricating oils (A) through (C) are shown in Table 1, and the mixing proportions and properties of oil mixtures (D) through (I) are shown in Table 2. Codes, such as ASTM D97, enclosed by parentheses in the Tables refer to methods for measuring the corresponding physical properties.

TABLE 1

Properties of Starting Oil

| Starting oil | Extract (X) | Lubricating base oil (A) | (B) | (C) |
|---|---|---|---|---|
| Polycyclic aromatic hydrocarbon (wt. %) | 19.3 | 0.3 | 0.1 | 4.9 |
| Aromatic hydrocarbon (wt. %) | 81.2 | 11.0 | 10.6 | 38.7 |
| Viscosity (40° C.) ($mm^2/s$) | 976.3 | 87.5 | 428.0 | 202.4 |
| Viscosity (100° C.) ($mm^2/s$) | 23.80 | 10.64 | 31.92 | 11.67 |
| Density (15° C.) ($g/cm^3$) | 1.0141 | 0.8741 | 0.8857 | 0.9378 |
| 5% Recovery temp. (° C.) | 409 | 426 | 504 | 413 |
| Pour point (ASTM D97) (° C.) | 12.5 | −15.0 | −12.5 | −22.5 |
| Aniline point (ASTM D611) (° C.) | 29.5 | 118.9 | 136.3 | 76.5 |
| Flash point (ASTM D92) (COC ° C.) | 256 | 270 | 316 | 230 |
| Refractive index (ASTM D1218) (20° C.) | 1.5750 | 1.4804 | 1.4865 | 1.5165 |

TABLE 2

Mixing Proportions and Properties of Oil Mixture

| Oil mixture | D | E | F | G | H | I |
|---|---|---|---|---|---|---|
| Proportions of oil mixture (Vol %) | | | | | | |
| Extract (X) | 90 | 70 | 50 | 30 | 70 | 70 |
| Lubricating base oil (A) | 10 | 30 | 50 | 70 | — | — |
| Lubricating base oil (B) | — | — | — | — | 30 | — |

TABLE 2-continued

Mixing Proportions and Properties of Oil Mixture

| Oil mixture | D | E | F | G | H | I |
|---|---|---|---|---|---|---|
| Lubricating base oil (C) | — | — | — | — | — | 30 |
| Polycyclic aromatic hydrocarbon (wt. %) | 17.4 | 13.6 | 9.8 | 6.0 | 13.5 | 15.0 |
| Aromatic hydrocarbon (wt. %) | 74.2 | 60.0 | 46.1 | 32.1 | 60.0 | 68.5 |
| Viscosity (40° C.) ($mm^2/s$) | 730.6 | 434.1 | 257.3 | 187.4 | 754.0 | 583.3 |
| Viscosity (100° C.) ($mm^2/s$) | 21.76 | 18.31 | 15.53 | 13.95 | 25.93 | 18.91 |
| Density (15° C.) ($g/cm^3$) | 1.0020 | 0.9769 | 0.9503 | 0.9206 | 0.9791 | 0.9924 |
| 5% Recovery temp. (° C.) | 410 | 415 | 418 | 423 | 452 | 410 |
| Aniline point (ASTM D611) (° C.) | 38.4 | 56.3 | 74.2 | 92.1 | 61.5 | 43.6 |
| Flash point (ASTM D92) (COC ° C.) | 258 | 261 | 263 | 266 | 284 | 248 |
| Refractive index (ASTM D1218) (20° C.) | 1.5655 | 1.5466 | 1.5277 | 1.5088 | 1.5485 | 1.5575 |

Examples 1 Through 7 and Comparative Examples 1 and 3

The above-described oil mixtures (D) through (I), extract (X), and a vacuum distillation fraction were used as starting materials. Extraction treatment was performed by use of a countercurrent extraction tower and furfural as a solvent. Principal extraction conditions and properties of the produced processing oils are shown in Table 3 for Examples 1 through 7 and in Table 4 for Comparative Examples 1 through 3.

TABLE 3

Examples of Present Invention
(Extraction Conditions and Properties of Processing Oils)

| Examples | 1 | 2 | 3 | 4 | 5 | 6 | 7 |
|---|---|---|---|---|---|---|---|
| Extraction Conditions | | | | | | | |
| Oil mixture | E | E | E | D | F | H | I |
| Solvent ratio (Volume ratio) | 1.0 | 1.5 | 1.5 | 1.5 | 1.0 | 1.5 | 1.5 |
| Top temperature of extraction tower (° C.) | 65 | 65 | 85 | 85 | 65 | 65 | 65 |
| Bottom temperature of extraction tower (° C.) | 50 | 50 | 60 | 60 | 50 | 50 | 50 |
| Yield of processing oil (vol. %) | 64 | 63 | 56 | 44 | 74 | 62 | 59 |
| Polycyclic aromatic hydrocarbon (wt. %) | 2.8 | 2.2 | 1.4 | 2.9 | 1.3 | 2.3 | 2.5 |
| Aromatic hydrocarbon (wt. %) | 49.4 | 47.8 | 45.9 | 60.0 | 35.4 | 47.7 | 56.5 |

TABLE 3-continued

Examples of Present Invention
(Extraction Conditions and Properties of Processing Oils)

| Examples | 1 | 2 | 3 | 4 | 5 | 6 | 7 |
|---|---|---|---|---|---|---|---|
| Viscosity (100° C.) ($mm^2/s$) | 12.70 | 12.44 | 12.22 | 13.00 | 12.13 | 20.82 | 12.59 |
| Density (15° C.) ($g/cm^3$) | 0.9275 | 0.9218 | 0.9138 | 0.9381 | 0.9075 | 0.9286 | 0.9338 |
| 5% Recovery temp. (° C.) | 429 | 416 | 407 | 392 | 431 | 445 | 402 |

TABLE 4

Comparative Examples
(Extraction Conditions and Properties of Processing Oils)

| Comparative Examples | 1 | 2 | 3 |
|---|---|---|---|
| Extraction Conditions | | | |
| Oil mixture (Base oil) | G | Extract (X) | Vacuum distillate |
| Solvent ratio (Volume ratio) | 1.0 | 1.0 | 0.6 |
| Top temperature of extraction tower (° C.) | 65 | 65 | 60 |
| Temperature of bottom of extraction tower (° C.) | 50 | 50 | 40 |
| Yield of processing oil (vol. %) | 84 | 10 | 84 |
| Polycyclic aromatic hydrocarbon (wt. %) | 0.8 | 13.6 | 4.9 |
| Aromatic hydrocarbon (wt. %) | 21.4 | 71.0 | 38.7 |
| Viscosity (100° C.) ($mm^2/s$) | 11.28 | 19.95 | 11.67 |
| Density (15° C.) ($g/cm^3$) | 0.8924 | 0.9941 | 0.9378 |
| 5% Recovery temp. (° C.) | 432 | 394 | 413 |

What is claimed is:

1. A method for producing a processing oil having a content of polycyclic aromatic hydrocarbon of less than 3 wt. %, comprising:

extracting an oil mixture with a polar solvent in an extraction tower, said oil mixture comprising from 3–60 vol % of a lubricating base oil and from 40–97 vol % of an extract obtained by the extraction of mineral oil with a polar solvent.

2. The method according to claim 1, wherein said extraction is a countercurrent extraction employing furfural as the extraction solvent under the conditions of (i) a volume ratio of solvent to oil mixture ranging from 0.5–2.5, (ii) a top temperature of the extraction tower of 50–110° C., and a bottom temperature of the extraction tower of 30–80° C.

3. The method according to claim 1, wherein the processing oil product obtained from the method comprises a polycyclic aromatic hydrocarbon in an amount of less than 3 wt. % and an aromatic hydrocarbon in an amount of 25 wt. % or more and having a kinematic viscosity at 100° C. of 10–30 $mm^2/s$, a density of 0.870–0.970 $g/cm^3$, and a 5 vol. % recovery temperature of 370–530° C.

4. The method according to claim 2, wherein the processing oil product obtained from the method comprises a polycyclic aromatic hydrocarbon in an amount of less than 3 wt. % and an aromatic hydrocarbon in an amount of 25 wt. % or more and having a kinematic viscosity at 100° C. of 10–30 $mm^2/s$, a density of 0.870–0.970 $g/cm^3$, and a 5 vol. % recovery temperature of 370–530° C.

* * * * *